United States Patent [19]

Marforio

[11] 3,998,172

[45] Dec. 21, 1976

[54] THREAD CUTTER DEVICE FOR SEWING MACHINES

[75] Inventor: Nerino Marforio, Milan, Italy

[73] Assignee: Rockwell-Rimoldi S.p.A., Milan, Italy

[22] Filed: Aug. 4, 1975

[21] Appl. No.: 601,526

[30] Foreign Application Priority Data

Aug. 7, 1974 Italy ..... 26072/74

[52] U.S. Cl. ..... 112/252

[51] Int. Cl.[2] ..... D05B 65/00

[58] Field of Search ..... 112/252; 83/324, 321, 83/360, 401, 673, 350

[56] References Cited

UNITED STATES PATENTS

| | | | |
|---|---|---|---|
| 2,293,236 | 8/1942 | Anderson | 112/252 |
| 2,318,843 | 5/1943 | Enos | 112/252 |
| 3,149,594 | 9/1964 | Buckreus et al. | 112/252 |
| 3,901,171 | 8/1975 | Rosa | 112/252 |

*Primary Examiner*—G. V. Larkin

[57] ABSTRACT

A device for selectively controlling the cover thread in sewing machines at the completion of the formation of a series of stitches which includes a cover thread positioning member for holding and accurately locating the cover thread for forming additional stitches in continuation of those previously formed or for cutting the thread while it is being held in preparation for forming a different series of stitches.

5 Claims, 6 Drawing Figures

THREAD CUTTER DEVICE FOR SEWING MACHINES

BACKGROUND OF THE INVENTION

The invention pertains to a thread-cutter device for the cover thread of a sewing machine.

As it is well-known to those conversant in the art, in sewing stitches where the thread of the needles is linked with a top thread that runs basically cross-wise along the stitches both for ornamental work and for covering any seams involved, the main difficulties arise when starting new stitches after completion of the previous stitch. These difficulties arise due to the fact that the top thread, commonly called the cover thread, is not caught by the top crochet hook unless it is in alignment with the path made by said crochet hook. While a certain amount of the threads of the needles and the bottom crochet hook can be made to protrude for easily restarting a stitch without causing a skip in the initial stitches of a series, this is not so for the cover thread, which must be precisely and accurately lined up with the top crochet hook to prevent so-called skips in the first stitches.

An object of the invention is to prevent the initial skip in cover stitches when restarting new stitches.

To achieve this object, the technical problem to be solved was that of embodying a thread-cutter device for the cover thread capable of locating the cover thread in a position which is in alignment with the top crochet hook so as to provide for this thread, at the beginning of a stitch, the same conditions that surround it after a few stitches have already been made.

SUMMARY OF THE INVENTION

The thread-cutter device according to the invention, includes a spring element that presses on the presser foot of the sewing machine, a movable thread-puller hook that is caused to move by any suitable means of control from an "off" position to a cover-thread catch position near the needle eye of the presser foot and vice-versa, and also a scissor-like cutting device is disposed between the spring element and the "off" position. The movable thread-puller hook catches the cover thread by moving first between the open blades of the scissor-like cutting device, then between the spring element and the presser foot and returns to the "off" position by moving first between the spring element and the presser foot and then between the open blades of the scissor-like cutting device, so the spring element will hold the cover thread and the scissor-like cutting device will cut the thread.

The combination of the spring element with the sole of the presser foot and with the movable hook, during the first phases of sewing, provides the same conditions that exist when the sewing is at an advanced and correct stage.

Consequently skips in the stitches are eliminated. The stitches have no defects and are identical to those made by manual positioning of the cover thread during the first phases of sewing. Undoubtedly the agility of the whole operation of cutting and restarting the stitch, now wholly automatic, saves considerable time in a phase of work that, up to now, negatively affected the whole operation.

The features and merits of the device which is the subject of this invention will become more fully apparent by reference to the appended claims and as the following detailed description proceeds in reference to the figures of drawing wherein:

DESCRIPTION OF THE PREFERRED EMBODIMENT

Figure 1:
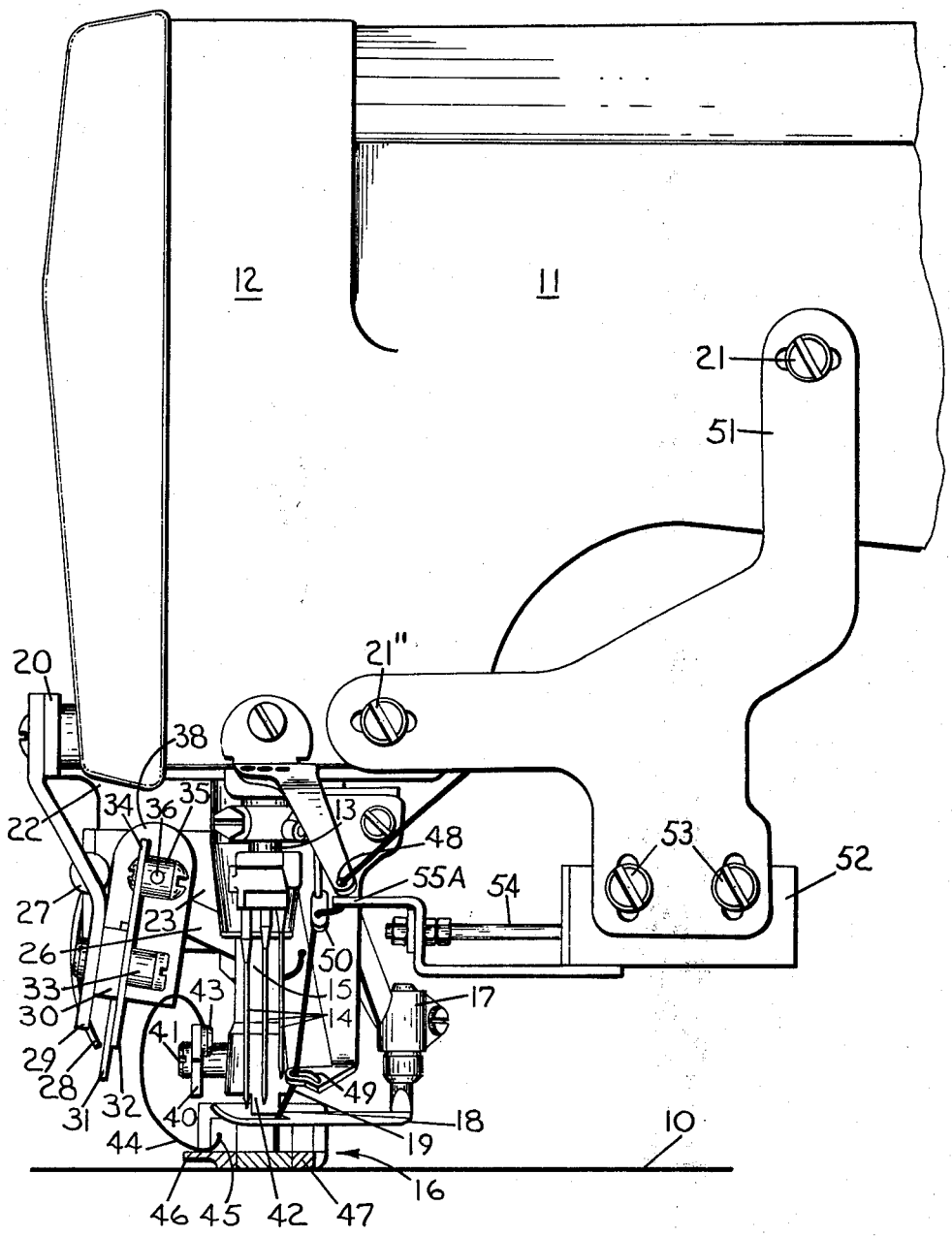
FIG. 1 is the front view of a sewing machine showing the thread-cutter device according to the invention applied thereto.

With particular reference to FIG. 1, a sewing machine having a support in the form of a work platen 10, is carried on the usual base (not shown), that houses the elements for sewing and conveyance as well as the main shaft of the machine.

Above the work platen 10, and spaced therefrom the conventional bracket arm 11, is provided with the free end supporting the usual head 12, that houses the controls for the upper mechanisms for sewing, which include a needle bar 13, equipped with the usual needles 14, and a presser bar 15, having a presser foot 16. The upper mechanisms for sewing also includes a movable support 17 for a top crochet hook 18 adapted to control a cover thread 19 so that it will pass alternately from right to left of the needles 14 and link it with the thread protruding from each needle to produce a standard ornamental stitch, for example No. 605.

Figure 2:
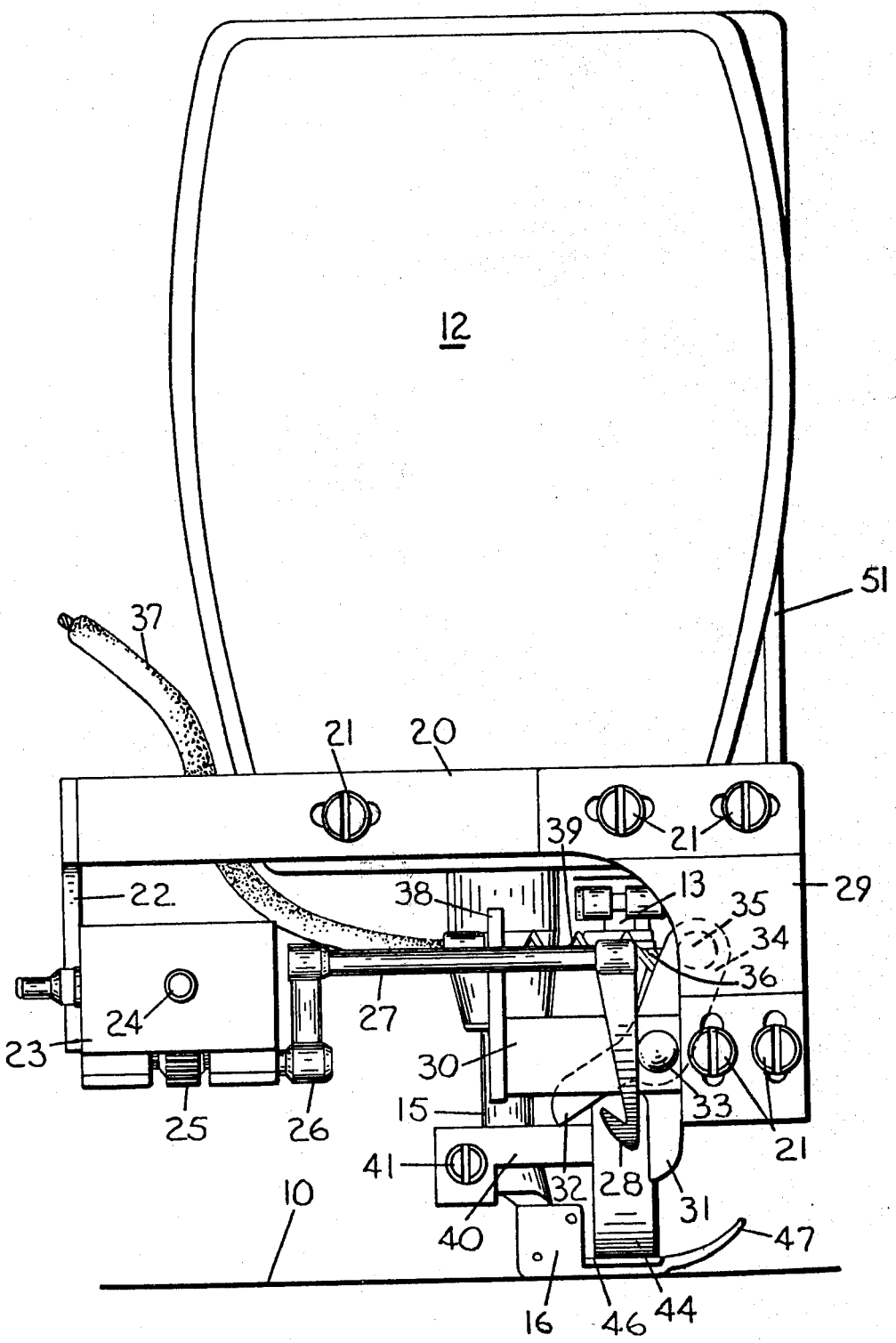
FIG. 2 is a view in side elevation of the apparatus in FIG. 1.

The thread-cutter device comprising the invention has a first bearing plate 20 (FIG. 2) adjustably attached to the head 12 by means of screws 21.

Bearing plate 20 has a depending bracket 22 which carries a pneumatic cylinder 23. This cylinder includes a piston rod 24 operatively connected to a rack (not shown) which meshes with a cog-wheel 25 that is connected to and effects pivotal movement of a lever 26. Lever 26 is fixed on one end of a rod 27 with the opposite end thereof having a cover thread positioning member in the form of a thread-puller hook 28 assembled thereon which is adapted to engage the cover thread 19 and locate it in the proper position to be cut.

Each time the piston rod 24 in the pneumatic cylinder 23 is actuated, the rack which effects movement of the cog-wheel 25 is also actuated causing lever 26 to pivot and locate hook 28 in its thread engaging position. A second support plate 29 is assembled to the first plate 20 by means of screws 21 and depending from said first plate its lower portion has a laterally extending third support plate 30 adjustably attached thereto by screws 21'. This thread support plate has a scissor-like cutting device carried thereon which includes a fixed blade 31 and a movable blade 32 pivoted on a pin 33.

The movable blade 32 includes an upwardly directed extension 34 which supports a clamp member 35 that has one end of a flexible cable 36 fixed therein. This cable is slidable within a casing 37 and the opposite end of the cable is kinematically connected to the presser bar 15. One end of a casing 37 engages a stop 38 having an aperture (not shown) through which the flexible cable 36 extends. A return spring 39 encircles the cable 36 in the area intermediate the stop 38 and clamp member 35 and serves to continuously urge the scissor-like cutting device to its open position.

A fourth support plate 40 is secured by a screw 41 to the usual support 42 of the presser foot 16. One end of an arcuated leaf-type spring 44 is attached to plate 40 by means of a screw 43 and its opposite end 45 being curved upwardly is in biasing contact with a projecting part 46 formed on one side of the sole 47 of the presser foot 16 and serves as a clamping means for the cover thread. A sewing machine equipped with a top crochet hook for the cover stitch usually includes a pair of spaced thread guide brackets disposed above the crochet hook with one thereof having an eye through which the thread extends that is identified by numeral 48 and the other a thread guide slot identified by numeral 49. Between the eye 48 and the thread guide slot 49 and operatively associated with the needle bar 13 a thread puller 50 is provided which takes up the slack in the thread produced by the crochet hook for the cover stitch during its return stroke. The thread cutter device for the cover thread also includes a support 51 secured by 21″ to the arm 11 of the sewing machine and supports a pneumatic cylinder 52 adjacent its lower end by means of screws 53.

The piston rod of this cylinder is identified by numeral 54 and is provided on its free end with a bracket 55A having a thread guide eye 55 disposed below the eye 48 which locates it between the latter and the thread puller 50 so as to provide the required amount of cover thread 19 each time the thread-cutter device is activated to make a cut.

Figure 3:
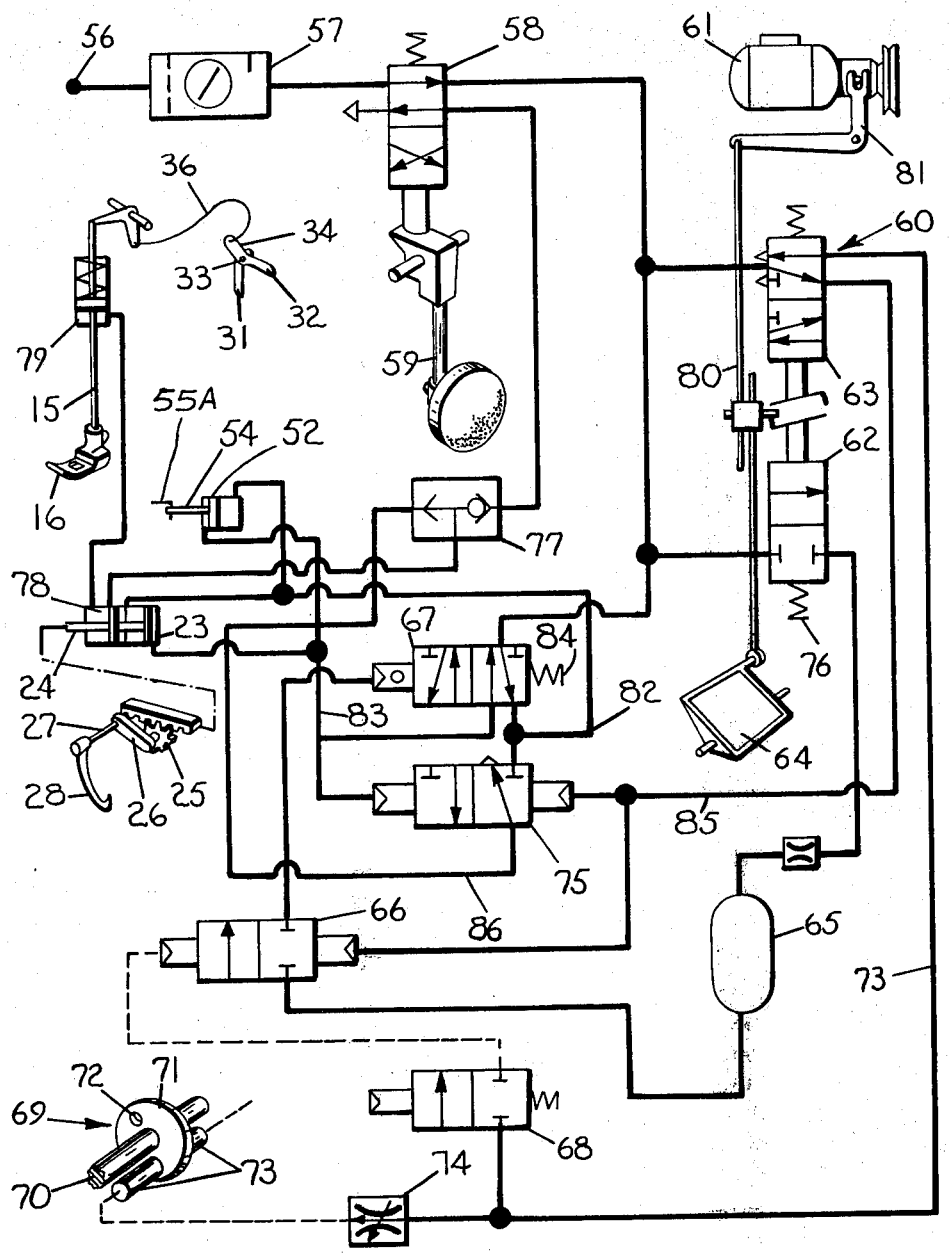
FIG. 3 shows schematically the pneumatic circuit for controlling the various mechanisms of the machine.

With reference to FIG. 3, the thread-cutter device is controlled by a pneumatic circuit which interconnects various elements of the sewing machine so that when any of them are activated, the inactive ones are not damaged.

The pneumatic circuit is connected to a feed line 56 having a self-contained unit 57 for filtering, regulating, and lubricating the air and includes a normally open first valve 58 that is activated by a knee control 59. This valve 58 is connected, in a way yet to be described, with the device for lifting the presser foot and bar and excludes that part of the circuit which controls the thread-cutter device when one wants only to lift the presser foot without cutting the cover thread. Under downtime conditions, this valve directs the compressed air to an on/off clutch control 60 of the sewing machine having a driving motor 61. This control includes a normally closed valve 62 and a commutator valve 63.

Either one of the valves can be set in action alternately by a foot pedal 64 which starts or stops the operation of the sewing machine.

Valve 62 is connected to a pneumatic reservoir 65 which stores a sufficient amount of compressed air to effect a single actuation of the thread-cutter device for each operation of sewing. Connected to the pneumatic reservoir is a slide valve 66 which is normally closed to prevent, during operation of the sewing machine, the thread-puller hook 28 and thread-puller 50 from being activated by an exchange valve 67 to whose activator said slide valve 66 is connected.

Valve 63 is connected to a normally closed valve 68 and to a fluid sensor 69 which moves the position taken by the needles 14 when they align with their uppermost position. The fluid sensor 69 is mounted on the main shaft 70 of the sewing machine and includes a rotating disk 71 having a through hole 72 which aligns once during each rotation with a duct 73 that connects valve 63 to the actuator of valve 68 by a pressure regulator 74.

To prevent compressed air from passing through hole 72 when the machine is operating, duct 73 is normally devoid of air and receives the latter only as a result of the actuation of valve 63.

To obtain the desired effect on the actuator of valve 68 when the hole 72 remains blocked and properly aligned with duct 73 the compressed air pressure in this duct is greatly reduced by a regulator 74 by comparison with the pressure during operation.

Valve 63 is also connected to the actuator of slide valve 66 and maintains this valve closed during machine operation and, the other actuator is connected to valve 68.

The actuator of a slide valve 75 is also connected to valve 63, and as slide 75 is pneumatically connected to the presser bar 15 it controls the lifting of this bar, as will be explained. Exchange valve 67 can send compressed air into pneumatic cylinders 23 and 52 so as to keep their respective pistons in an "off" or inactive position.

To summarize the operation, when the operator completes a stitch or a series thereof she can raise the presser foot without activating the thread-cutter device and take up the stitch from where she left off, or she can cut the cover thread, then raise the presser foot.

In the first instance, the operator discontinues pressing on the pedal 64 to stop the sewing machine. In so doing, she shuts off valve 62 which returns to the position shown in FIG. 3 under the force of spring 76.

The pneumatic reservoir 65 retains the compressed air which was stored while the sewing machine was operating. By moving the knee control 59 in the customary manner the operator causes valve 58 to change position which stops the flow of compressed air to both control 60 and to exchange valve 67.

At the same time, the passage of air to the control for lifting the presser foot 16 is opened by a unidirectional valve 77 which then prevents the connection to the slide valve, 75.

By a control element 78 connected to cylinder 23 which allows the passage of compressed air only when piston 24 is in "off" position, the air enters a single-acting pneumatic cylinder 79 whose piston is connected on one side to the presser bar 15 and on the other side to the movable blade 32 of the scissor-like cutting device by the flexible cable 36.

When the operator releases the knee control 59 the presser foot 16 returns to its work position, and compressed air passes again through the commutator valve 63 to the actuators of valves 66 and 75 and valve 67 directly.

In the second instance, if the operator desires to cut the cover thread, she must lift her toe from the pedal 64, and press it with her heel which pivots the pedal in the opposite direction, causing upward movement of rod 80 and the actuation of lever 81 which is connected to motor 61. In this way, valve 62 is deactivated while the position of valve 63 is reversed to stop the passage of air to the actuators of valves 66 and 75 and opens the passage of air to valve 68 and the fluid sensor 69. By means of the fluid sensor, air passes only when the needles 14 align with their uppermost position. In this position, the hole 72 of the fluid sensor 69 aligns with duct 73, enabling compressed air to enter the actuator of slide valve 66 thus switching its position. The air in the pneumatic reservoir 65 presses the actuator of exchange valve 67, which switches its own connections, causing the air in cylinders 23 and 52 to be released through a duct 82 and causing the successive filling of said cylinders with air passing inside a duct 83 to reach the respective pistons on their opposite sides. The thread-puller hook 28 then lowers and engages the cover thread 19 which must be cut, while the thread-puller 50 draws new cover thread through eye 48 from the spool before the hook 28 completes its return stroke. The same air in duct 83 causes the switching in slide valve 75 so as to set up a passage for the air coming from line 56 through valve 58 and exchange valve 67.

As the compressed air in the pneumatic reservoir is limited once it runs out, the pressure on the actuator of exchange valve 67 ceases and said valve reassumes its prime position under the force of a return spring 84 reconnecting line 56 with the slide valve 75.

During the forward movement of piston rod 24 within the pneumatic cylinder 23 the passage of air inside the control element 78 is prevented and the presser foot 16 cannot be lifted until the piston 24 returns to its prime position.

In the new position taken by exchange valve 67, air in the pneumatic cylinders 23 and 52 is released and the force on the actuator through duct 83 stops. However, valve 75 does not change, since valve 63 is still in a different position, because the operator continues to engage the pedal 64.

Figure 4:
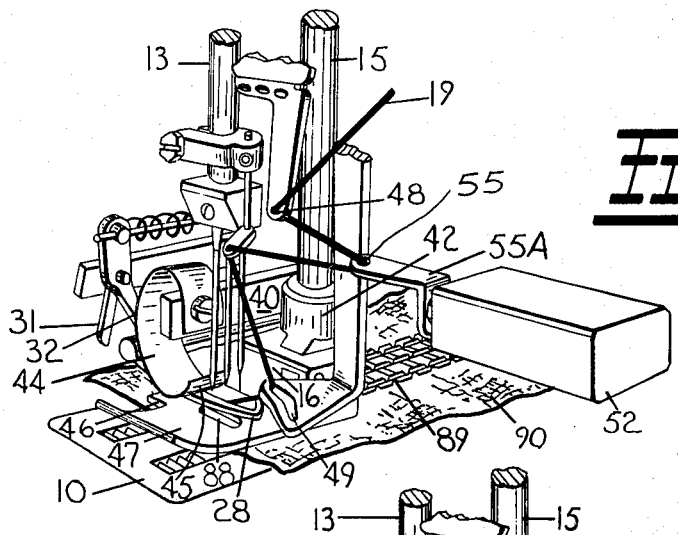
FIGS. 4, 5 and 6 show the thread-cutter device according to the invention in the different positions it assumes during the performance of its intended function.
Figure 5:
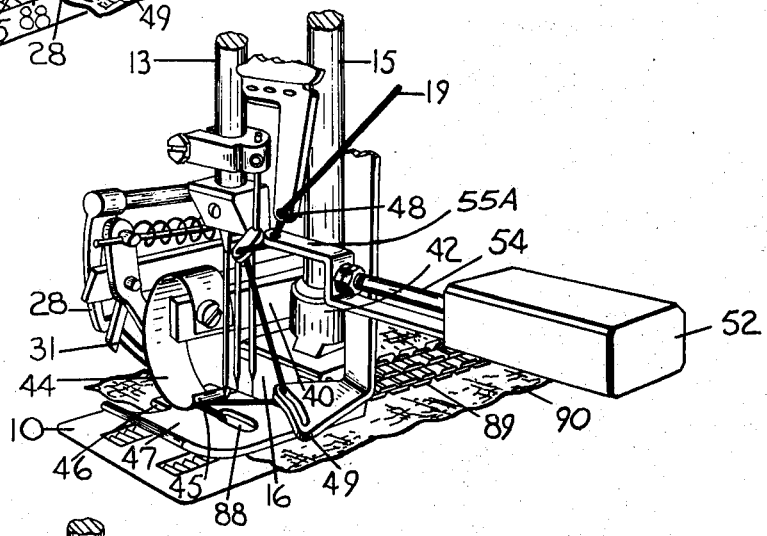
Figure 6:
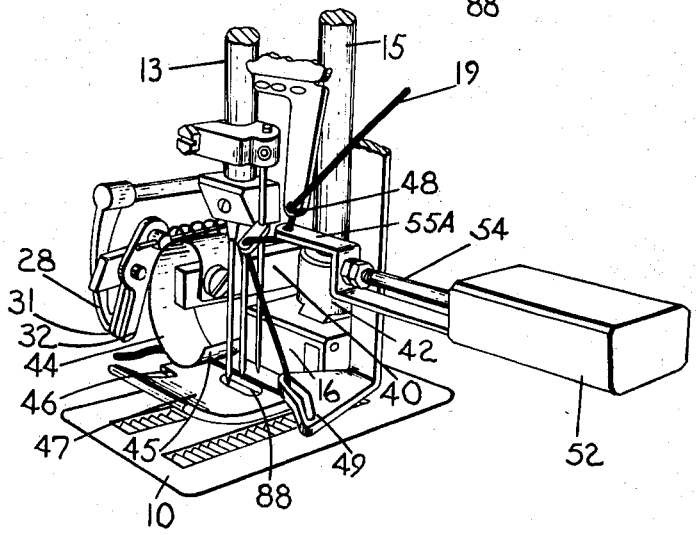

The air from exchange valve 67 passes directly into the pneumatic cylinders 23 and 52 through duct 82 moving pistons thereof to their "off" position. In particular the opening of the air passage inside the control element 78 follows the movement of the piston 24 so that the presser foot 16 is caused to lift from the work below. With reference to FIGS. 4, 5 and 6 the movable thread-puller hook 28 moves between the leaf-type spring 44 and the projecting part 46 in line with and to a position beyond the cover thread, which becomes subtended between the thread guide slot 49 and the needle opening 88 in the sole 47. Obviously, on the side of the needle eye, the cover thread 19 becomes sewn into the row of stitches 89 formed in the workpiece 90 shown in FIGS. 4 and 5.

During its return stroke, the movable thread-puller hook 28 draws the cover thread beneath the leaf-type spring 44 which clamps it against the projecting part 46 and also draws said thread to a position where it extends between the open blades 31 and 32 of the scissor-like cutting device.

Finally, the presser foot 16 is lifted, and the scissor-like cutting device is closed, and the thread is cut.

The presser foot 16 remains in an elevated position until the pedal 64 is released.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A thread-cutter device for the cover thread of a sewing machine comprising:

a. a presser bar slidably mounted in the head of the sewing machine;

b. a presser foot attached to said presser bar;

c. clamping means connected to said presser bar for operative association with said presser foot;

d. means defining a thread cutter attached to and movable with said presser bar; and e. a cover thread positioning member pivoted on the head of the sewing machine and selectively movable for moving the cover thread to a position of engagement by said clamping means and for cutting by said thread cutter.

2. The thread cutter device according to claim 1 wherein said clamping means includes an arcuated leaf-type spring member having one end thereof disposed in frictional engagement with said presser foot.

3. The thread cutter device according to claim 1 wherein said means defining a thread cutter includes a fixed blade, a movable blade and a biasing means for continuously urging said movable blade to a position spaced from said fixed blade.

4. The thread cutter device according to claim 3 wherein said thread-cutter includes a control means for selective actuation thereof.

5. The thread cutter device according to claim 1 wherein said cover thread positioning member defines a thread-puller hook with means operatively associated therewith for selectively moving said hook between positions for engaging and moving the cover thread to a position to be held between said clamping means and said presser foot.

* * * * *